United States Patent [19]

Canlas, Jr.

[11] Patent Number: 4,767,043

[45] Date of Patent: Aug. 30, 1988

[54] FASTENER DRIVING DEVICE WITH IMPROVED COUNTERSINK ADJUSTING MECHANISM

[75] Inventor: Prudencio S. Canlas, Jr., North Kingstown, R.I.

[73] Assignee: Stanley-Bostitch, Inc., East Greenwich, R.I.

[21] Appl. No.: 70,025

[22] Filed: Jul. 6, 1987

[51] Int. Cl.[4] ..... B25C 1/04

[52] U.S. Cl. ..... 227/8; 227/130; 227/156

[58] Field of Search ..... 227/8, 130, 142, 156

[56] References Cited

U.S. PATENT DOCUMENTS

| | | | |
|---|---|---|---|
| 3,464,614 | 9/1969 | Volkmann | 227/130 |
| 3,519,186 | 7/1970 | Volkmann | 227/8 |
| 3,708,096 | 1/1973 | Burke | 227/130 |

*Primary Examiner*—E. R. Kazenske
*Assistant Examiner*—James Wolfe
*Attorney, Agent, or Firm*—Cushman, Darby & Cushman

[57] ABSTRACT

A portable power operated fastener driving device including a work contact assembly having a manual adjusting mechanism for adjusting the extent to which fasteners driven by the fastener driving element of the device are countersunk into the workpiece. The manual adjusting mechanism includes a manually operable member movable by manual engagement to effect an adjustment of the adjusting mechanism and a releasably lock movable between a locking position for locking the manually operable member against manual movement and a releasing position enabling the manually operable member to be manually moved. A guard assembly encloses at least a portion of the adjusting mechanism including the manually operable member. The guard assembly includes a manually operable access door movable between a closed position wherein the manually operable member is manually inaccessible within the guard assembly and an open position wherein the manually operable member is manually accessible. A mechanism is provided for moving the releasable lock between its locking and releasing positions when the access door is manually moved between its closed and open positions respectively.

13 Claims, 4 Drawing Sheets

FASTENER DRIVING DEVICE WITH IMPROVED COUNTERSINK ADJUSTING MECHANISM

This invention relates to fastener driving devices and, more particularly, to portable power actuated fastener driving devices.

Power actuated fastener driving devices of the type herein contemplated are, for the most part, of the fluid pressure operated type, although solenoid operated devices and internal combustion operated devices are also contemplated. Most portable power actuated fastener driving devices are provided with an actuating mechanism which includes two components; one, a trigger member and two, a contact trip member. These members are interrelated by an enabling mechanism which causes an actuating member to be moved when both the contact trip and trigger members are moved from their normal inoperative positions into their operative positions. The contact trip member is moved from its normal inoperative position into its operative position by movement of the portable device into engagement with the workpiece. The trigger member is moved by a digital pressure by the operator. It is well known that actuating mechanisms can be either of the sequential type or of the concomitant type. A sequential actuating mechanism requires the operator to move first the contact trip member into its operative position and then the trigger member into its operative position in order for the actuating member to be moved. The concomitant type is one in which the actuating member will move in response to the movement of both the contact trip and trigger member into their operative positions irrespective of the order in which they are moved therein. The present invention contemplates both types of actuating mechanisms.

In the usual situation, the portable device includes a housing which defines a vertically extending drive track. The terminal end of the drive track is usually defined by a fixed nosepiece and the contact trip member is simply a member which is spring biased into its normal inoperative position so as to extend below the nosepiece and is moved from its normal inoperative position into its operative position when the fixed nosepiece of the portable device is moved into contact with the workpiece. It has been recognized, however, that if the fastener driving element is mounted so that its fastener engaging surface extends below the workpiece engaging surface of the fixed nosepiece at the end of the drive stroke, the fastener being driven will be countersunk into the workpiece. It is also known that if the contact trip member is then made to be the device which is in contact with the workpiece when the device is in work engaging contact, the assembly connected to the contact trip member can be rendered adjustable to render the device capable of adjusting the extent of which countersinking will occur. An example of a device of this type is disclosed in U.S. Pat. No. 3,519,186, dated July 7, 1970. U.S. Pat. No. 3,464,614, dated Sept. 2, 1969, discloses a countersink adjustment in which the entire nosepiece is movable and functions as a contact trip.

In instances where finishing operations are being undertaken and the fastener driving device is being utilized with finishing nails, it is highly desirable to achieve a countersink of the head of the nail in relation to the workpiece surface. Where different materials are encountered it is desirable to be able to make a simple adjustment to achieve the desired countersunk relationship. The adjustments disclosed in the aforesaid patents can be accomplished manually. However, they do require the utilization of tools and for that reason are complicated by the need to have available the tools required to effect adjustment. The capability of a manual adjustment without tools is highly desirable. So long as they are effectively retained in adjusted position and are not capable of being easily moved out of adjustment either by vibrations imparted to the tool as by direct contact during the handling of the device.

An object of the present invention is to provide an adjusting mechanism which optimizes both the ease in accomplishing the adjustment manually without the use of tools and the ability to reliably retain the adjusting mechanism in any position of adjustment into which it is manually moved. In accordance with the principles of the present invention, this objective is obtained by providing a work contact assembly which includes a manual adjusting mechanism for adjusting the extent to which fasteners driven by the fastener driving element of the portable device are countersunk into the workpiece. The manual adjusting mechanism includes a manually operable member movable by manual engagement to effect an adjustment of the adjusting mechanism and a releasably locking assembly movable between a locking position for locking the manually operable member against manual movement and a releasing position enabling the manually operable member to be manually moved. A guard assembly encloses at least a portion of the adjusting mechanism including the manually operable member, the guard assembly including a manually operable access door movable between a closed position wherein the manually operable member is manually inaccessible within the guard assembly and an open position wherein the manually operable member is manually accessible, and a mechanism for moving the releasable locking assembly between the locking and releasing position thereof when the access door is manually moved between its closed and open positions respectively.

Still another object of the present invention is the provision of a portable power actuated fastener driving device having a work engaging assembly which includes a first structure having a portion extending from the fixed nosepiece of the device in the direction of extent of the drive track therefrom and a second structure having a portion operatively associated with the enabling assembly of the actuating mechanism. Interconnected between the first and second structures are first and second threaded members interengaged for relative movement between a first position of adjustment wherein the first structure portion when the work contact assembly is in its operative position extends from the nosepiece a maximum extent and a fastener driven into a workpiece by the fastener driving element has a minimum countersunk relation and a second position of adjustment wherein the first structure portion when the work contact assembly is in its operative position extends from the fixed nosepiece a minimum extent and a fastener driven into a workpiece by the fastener driving element has a maximum countersunk relation. The first of said threaded members includes a manually engageable surface for enabling the same to be manually turned to move the structures in a multiplicity of different positions between the first and second positions of adjustment. A manually operable mechanism is provided for releasably locking the threaded members in any position into which the one threaded member is manually turned.

A further object of the present invention is the provision of an adjusting mechanism of the type described which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
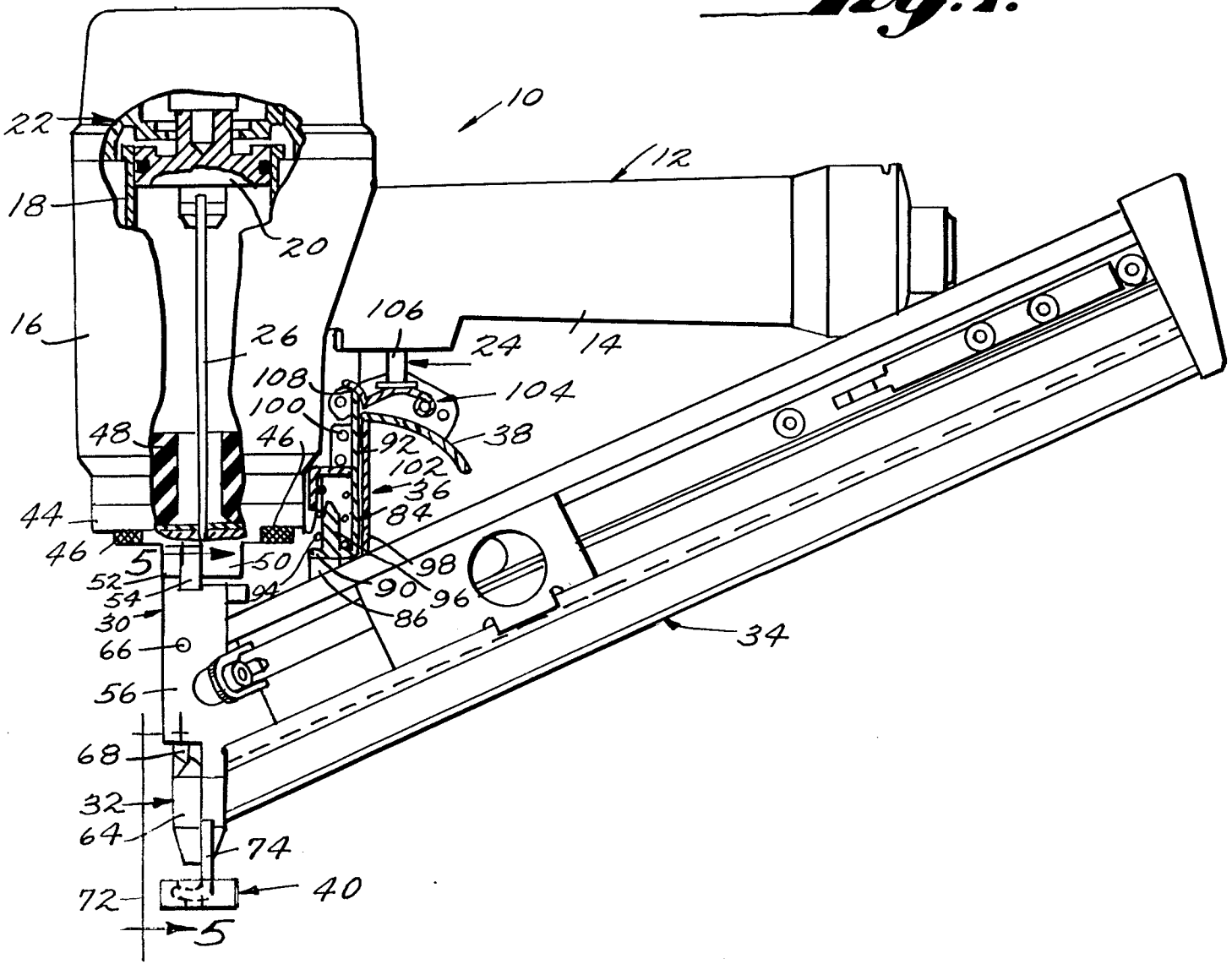
FIG. 1 is a righthand side elevational view, with parts broken away for purposes of clear illustration, of a portable power operated fastener driving device embodying the principles of the present invention.

Referring now more particularly to the drawings, there is shown in FIG. 1 thereof a portable power operated fastener driving device, generally indicated at 10, which embodies the principles of the present invention. The power operated device illustrated is of the fluid pressure operated type and includes the usual portable housing, generally indicated at 12, which includes a handle grip portion 14 of hollow configuration which constitutes a reservoir for air under pressure coming from a source which is communicated therewith. The forward end of the grip portion intersects with a vertical housing portioh 16. Mounted within the housing portion 16 is a cylindrical member 18 defining a cylindrical chamber within which a piston 20 is slidably sealing mounted for movement from an upper position, as shown, through a drive stroke into a lowermost position and from the lowermost position through a return stroke back into its upper limiting position. A main valve, generally indicated at 22 , is provided for controlling communication of the reservoir pressure to the upper end of the cylinder to effect the driving movement of the piston. The main valve 22 is pilot pressure operated and the pilot pressure chamber thereof is under the control of an actuating valve, generally indicated at 24. It will be understood that the actuating valve and main valve may be of any known configuration. One example is disclosed in commonly assigned U.S. Pat. No. 3,708,096, the disclosure of which is hereby incorporated by reference into the present specification. Means is provided within the housing 12 to effect the return stroke of the piston 20. For example, such means may be in the form of a conventional plenum chamber return system such as disclosed in the aforesaid patent.

In accordance with the usual practice, a fastener driving element 26 is suitably connected with the piston 20 and is slidably mounted within a drive track 28 (see FIG. 3) formed in a nosepiece assembly, generally indicated at 30, forming a fixed part of the housing 12. The nosepiece assembly 30 as illustrated includes a jam-clearing mechanism 32 similar to that disclosed in commonly assigned U.S. Pat. No. 3,934,778, the disclosure of which is hereby incorporated by reference into the present specification. The jam-clearing mechanism 32 embodied in the nosepiece assembly is movable only when it is desired to clear the drive track of a jammed fastener. In normal operation, the nosepiece assembly including the jam clearing mechanism 32 is operationally rigid. It will be understood that a fully rigid nosepiece assembly without a jam clearing mechanism may be utilized if desired.

Fixed to the nosepiece assembly 30 is a magazine assembly, generally indicated at 34, which is operable to receive a supply of fasteners and to feed the leading fastener of the supply into the drive track to be driven therefrom by the fastener driving element. The fasteners utilized are of the type capable of being countersunk as, for example, finishing nails. An exemplary embodiment of an appropriate fastener is disclosed in commonly assigned international patent application No. PCT/US/87/00812, filed Apr. 9, 1987. An exemplary magazine assembly is of the well known spring pressed pusher type.

The present invention is more particularly concerned with an improved actuating mechanism 36 for initiating the drive stroke of the fastener driving element 26. The actuating mechanism 36 includes essentially two manually operable elements, one of which is a trigger member 38 which is pivotally mounted to the housing 12 in a position to be moved from a normal spring-biased inoperative position, by digital engagement of the operator's hand grasping the handle, into an operative position. The actuating mechanism 36 also includes a work engaging or contacting assembly, generally indicated at 40, which embodies an adjusting mechanism, generally indicated at 42, which provides the operator with the capability of manually selecting the extent to which a fastener driven out of the drive track 28 by the fastener driving element 26 will be driven into and countersunk with respect to the workpiece.

The nosepiece assembly 30, which forms a part of the housing 12, includes a chamber bottom closure member 44 suitably fixed, as by bolts 46, to the lower end of the hollow vertical portion 16 of the housing 12. The closure member 44 encloses the bottom of the drive chamber within which is mounted a resilient bumper member 48 engageable by the piston 30 when it reaches the end of its drive stroke. The closure member 44 includes a pair of laterally spaced depending mounting tabs 50 which are suitably formed with interiorly threaded apertures for receiving mounting bolts 52. Bolts 52 extend through mounting ears 54 formed on the upper end of a rigid nosepiece 56.

The upper portion of the closure member 44 includes a central vertical passage forming the upper end of the drive track 28. The rigid nosepiece 56 includes a forwardly facing surface defining the rearward extent of the remainder of the drive track 38. The forward extent of the drive track is defined along its upper portion by a rearwardly facing surface of a guide block 58 suitably fixed, as by a bolt 60, to a central depending lug 62 formed integrally with the closure member 44. The forward extent of the drive track 28 below the guide block 58 is defined by a rearwardly facing surface of a pivoted door member 64 forming a part of the jam clearing mechanism 32.

Figure 3:
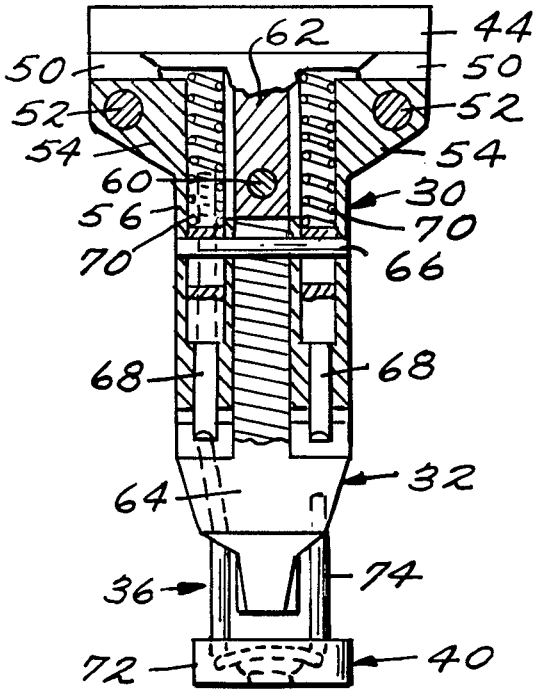
FIG. 3 is an enlarged fragmentary sectional view taken along the line 3—3 of FIG. 1.

As best shown in FIG. 3, the door member 64 is generally of inverted T-shaped configuration, the stem of which seats within a complimentary recess in the nosepiece 56. A pivot pin 66 extends across the nosepiece within the recess and through the upper portion of the stem of the inverted T-shaped door member 64 to mount the same for pivotal movement from the normally closed vertically extending operating position shown to an open jam clearing position extending horizontally forwardly. The door member 64 is releasably retained in its operating position by a pair of spring pressed latch elements 68. As shown, the lower ends of the latch elements 68 are tapered and engage over inclined latching surfaces on the adjacent portions of the inverted T-shaped door member 64. The upper ends of the latch elements 68 are slotted to receive pivot pin 66 therethrough and the upper slotted ends abuttingly engage the lower ends of a pair of coil springs 70. The upper ends of the coil springs 70 engage the closure member so as to resiliently bias the latch members into their lower latching position as shown. The door is moved into its jam clearing position by prying the same forwardly until the tapered and inclined surfaces cam the latch elements upwardly into a releasing position.

The work engaging assembly 40 is in the form of first and second rigid structures interconnected by the manual adjusting mechanism 42. The first rigid structure includes a centrally apertured work contacting block 72 within which is seated a lower looped portion of a guide rod 74. Guide rod 74 includes a first relatively short end slidably mounted in the fixed nosepiece 56 and a second relatively long end portion having exterior threads 76 formed thereon. An adjusting cylindrical member 78 is formed with interior threads in meshing engagement with the exterior threads 76. The adjusting member 78 is exteriorly striated or formed with manually engageable knurling grooves 80 on its exterior periphery for cooperation with a selective locking mechanism, generally indicated at 82. Locking mechanism 82 is movable between locking and releasing positions in response to the manual movement of an access door mechanism, generally indicated at 84, between a closed position as shown in solid lines in FIGS. 4 and 5 and an open access position as shown in dotted lines in FIGS. 4 and 5.

The second rigid structure of the work contacting assembly 40 is in the form of a bracket, generally indicated at 84, including an L-shaped central portion 86 having a pair of parallel flanges 88 extending from opposite sides of the horizontal leg thereof and disposed on opposite sides of the adjusting member 78. Flanges 88 are apertured to receive the threaded end portion of the rod 74 therethrough. It can be seen that since the adjusting member 78 is captured between the flanges 86, the position of the adjusting member 78 on the threaded rod end 76 determines the position of the second rigid structure or bracket 84 with respect to the first rigid structure consisting of the rod 74 and block 72. The bracket 84 also includes a horizontally extending portion 90 bent inwardly from the upper end of the vertical leg of the L-shaped central portion 86. A vertically extendihg portion 92 is bent upwardly from the rearward edge of the horizontal portion 90.

The bracket 84 and hence the entire work contacting assembly 40 is resiliently urged into a normal inoperative position by a coil spring 94 seated at its lower end on the horizontal bracket portion 90. A stop and guide rod 96 is fixed to the bracket portion 90 and extends upwardly within the coil spring 94. A U-shaped guide element 98 has its legs fixed, as by fasteners 100, to a recessed portion of the housing 12 in a position to guide the vertical bracket portion during its vertical movement from the aforesaid normal inoperative position into an actuating position. An L-shaped element 102 fixed between the legs of the guide element 98 receives the upper end of the coil spring 94 and serves as an abutment to be engaged by the upper end of the stop rod 96. The engagement of the horizontal bracket portion 90 with the magazine 34 serves as a limit to the downwardly biased movement of the work contact assembly 40 into its inoperative position.

The upper end of the vertical bracket portion 92 extends into cooperating association with an enabling mechanism, generally indicated at 104, which is also cooperatively associated with the trigger member 38 and an actuating member 106 of the actuating valve 24. The enabling mechanism 104, as shown, is concomitantly operable in response to the movement of the trigger member 38 and work contact assembly into their operative positions in either order to move the actuating member 106 into an operative position to actuate the valve 24 and hence main valve 22. The enabling mechanism 10 could be of the sequential type, if desired. As shown, the concomitant embodiment thereof consists essentially of a lever 108 pivoted on the trigger member 38 having its free end disposed in overlying relation to the end of the vertical bracket portion 92 and its central portion underlying the lower end of the valve actuating member 106.

The access door mechanism 84 forms a part of a guard structure, generally indicated at 104, which protects the adjusting mechanism 42 from accidental or unwanted movement. As shown, the guard structure 104 is in the form of a bent sheet metal member including a central portion 106 of L-shaped cross-section. A lower horizontal portion 108 extends forwardly from the lower end of the central portion 106 and has a depending mounting flange 110 thereon. A bolt 112 extends through the mounting flange and into the adjacent magazine so as to fix the lower portion of the guard structure with respect to the housing 12. The guard structure 104 also includes an upper portion 114 extending forwardly from the upper end of the central portion 106 and having a mounting flange 116 extending horizontally from the upper edge thereof. Mounting flange 116 is apertured to receive one of the bolts 46 which serves to fix the upper end of the guard structure 104 to the housing 12.

The access door mechanism 84 includes a door member 118 of a shape to enclose the space extending forwardly of the central guard portion 106 between the spaced horizontal guard portions 108 and 114. As can be seen from FIG. 2, the door member 118 thus encloses the threaded end 76 of the rod 74, the adjusting member 78 and the central portion 86 of the bracket 84. The portion of the rod 74 below the threaded end 76 is enclosed by a separate guard plate 120 fixed thereover by the bolt 112.

Figure 2:
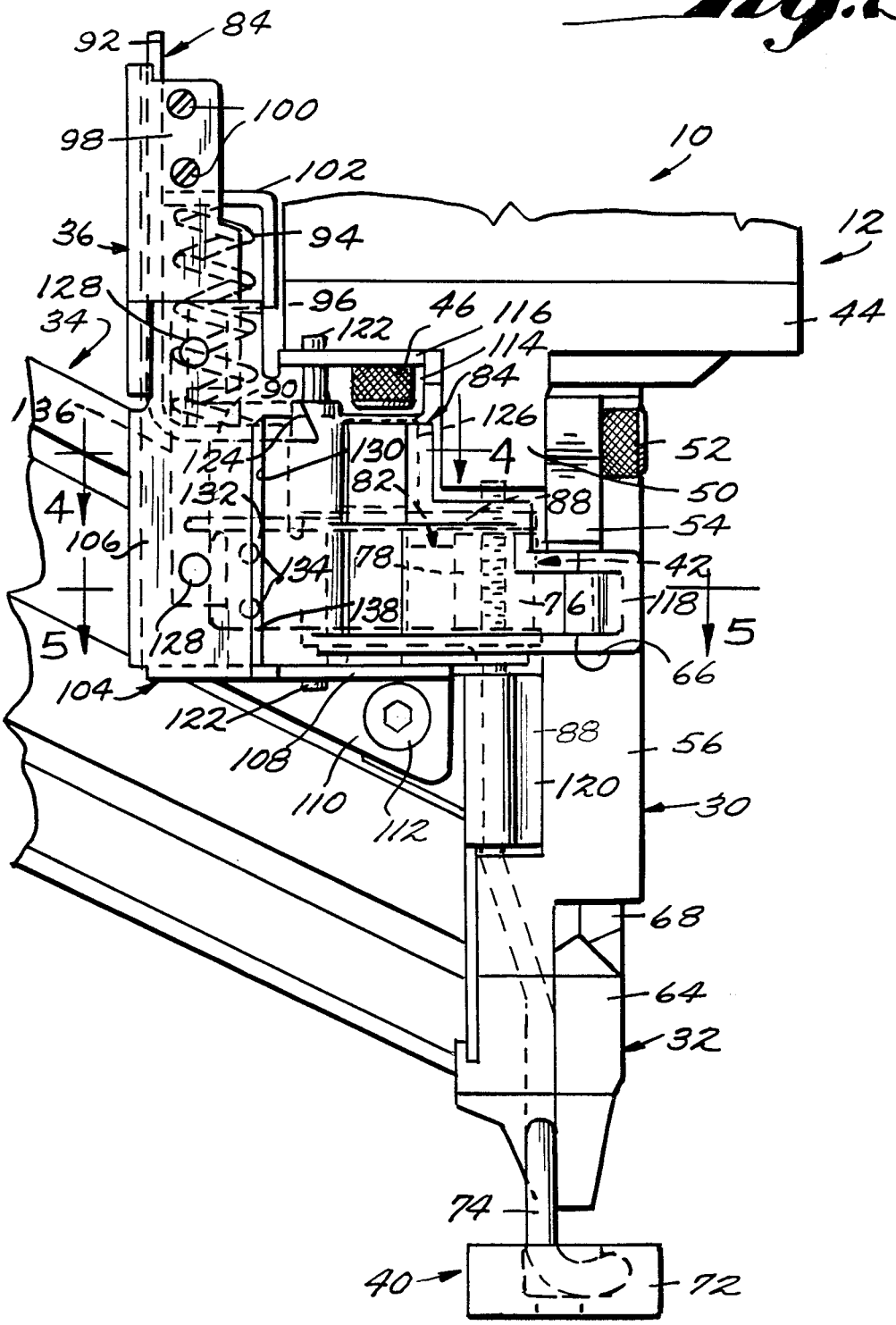
FIG. 2 is an enlarged fragmentary left side elevational view of the portion of the device adjacent the nosepiece thereof.
Figure 4:
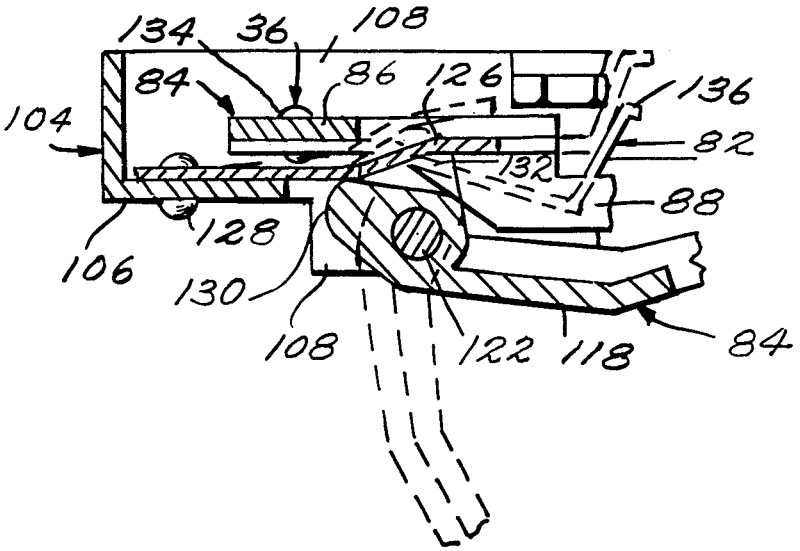
FIG. 4 is an enlarged fragmentary sectional view taken along the line 4—4 of FIG. 2.
Figure 5:
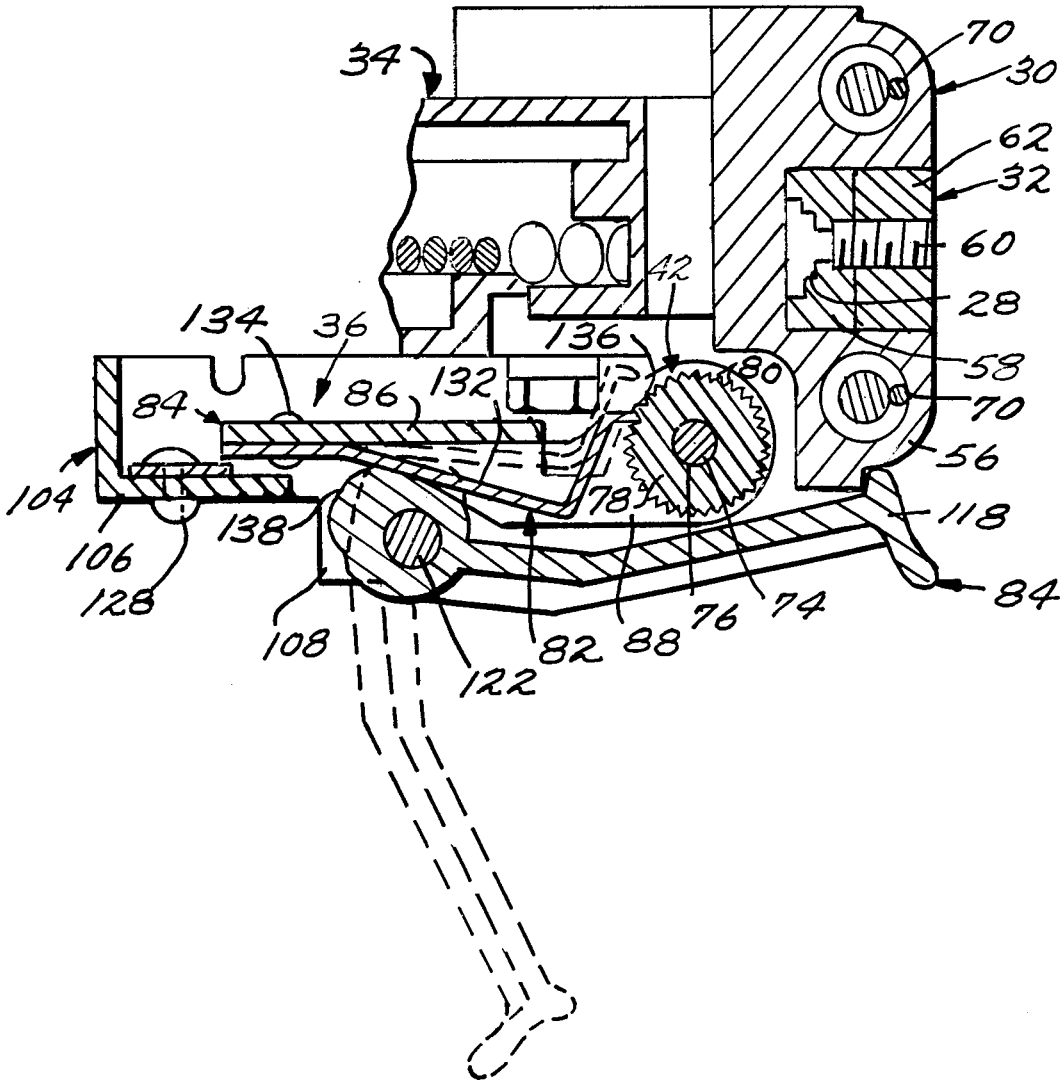
FIG. 5 is an enlarged fragmentary sectional view taken along the line 5—5 of FIG. 2.

Door member 118 is pivoted for movement from the closed position shown in FIG. 2 and in solid lines in FIGS. 4 and 5 into an open access position, as shown in dotted lines in FIGS. 4 and 5, by a pivot pin 112 which extends through the lower horizontal guard portion 108 and the upper mounting flange 116. A stop element 124 serves to limit the pivotal movement of the door member to the access position shown. As best shown in FIG. 4, a leaf spring 126 is fixed, as by rivets 128, to the central guard portion 106 and extends in cantilever fashion forward into the path of movement of an upper cam surface 130 formed on the pivotal portion of the door member 118. Cam surface 130 is configured so that leaf spring 126 serves to resiliently bias the door member 118 into its closed position and into its open position after it has been manually moved beyond an intermediate position. Conversely, the door member 118 must be manually moved from its open position beyond the intermediate position before being biased fully into its closed position.

As best shown in FIG. 5, the locking mechanism 82 preferably is in the form of a leaf spring 132 having its rearward end fixed, as by rivets 134 or the like, to the central portion 86 of the bracket 84. The forward end of the leaf spring is bent, as indicated at 136, so as to engage the striated exterior periphery of the adjusting member 78 in locking or turn preventing relation. The pivot portion of the door member 118 includes a lower cam surface 138 disposed in a position to engage the central portion of the leaf spring 132. The cam surface 138 is configured to move the leaf spring in a direction to disengage the bent end 136 from the striated periphery of the adjusting member when the door member 118 is moved from its closed position into its open position.

The operation of the actuating valve 24 and the main valve 22 to effect the drive stroke of the piston 20 and fastener driving element 26 is of a conventional nature. This actuation is accomplished in response to the movement of the actuating member 106 of the actuating valve 24 from its normal inoperative position as shown in FIG. 1 upwardly into its operative position. This movement is accomplished by the actuating mechanism 36. The actuating mechanism 36, as shown, is of the concomitant type and serves to move the actuating member 106 into its operative position when the operator moves the work contacting block 72 into engagement with the workpiece which is to receive the fastener and digitally moves the trigger member 38 into its operative position. The work contacting block 72 is normally resiliently biased into its inoperative position by coil spring 94. The extent of its movement when the operator engages the same with the workpiece is determined by the engagement of the stop rod 96 with the L-shaped element 102. The adjusting mechanism 42 is mounted between the stop rod 96 and the work contacting block 72 so as to vary the position of the work contacting block when the stop rod 96 is in engagement with the L-shaped element 102. The relative position of the work contacting block 72 also varies with respect to the position of the lower end of the fastener driving element 26 when the same reaches the end of its drive stroke. This position is disposed below the end of the rigid nosepiece 56. The extent to which this position is also below the lower surface of the work contacting block 72, when the stop rod 96 is in engagement with the element 102, determines the extent to which the fasteners driven by the fastener driving element 26 are countersunk into the workpiece. Consequently, the operation of the adjusting mechanism 42 serves to adjust the extent of the fastener countersink accomplished by the operation of the fastener driving device 10.

It will be noted that when door 118 is disposed in its closed position as illustrated in FIG. 2, the locking mechanism 82 is operable to maintain the adjusting mechanism 42 in the adjusted position into which it has been moved. The locking mechanism effectively prevents rotational movement of the adjusting member 76 by engagement of the end 136 of the locking leaf spring 132 in the striated exterior periphery 80 of the adjusting member 78. To operate the adjusting member, the operator first manually engages the door member 118 and moves it from its spring biased closed position outwardly towards its open access position. When the door member has been moved past an intermediate position determined by the cam surface 130, the leaf spring 126 is then operable to maintain the door member 118 in its open access position. It will also be noted that during the movement of the door member 118 from its open position, cam surface 138 will be operative to move the end 136 of the leaf spring locking member 132 from its position of engagement with the striated periphery 80 of the adjusting member 78 to a position disposed out of engagement therewith as shown in dotted lines in FIG. 5. The disengagement of the locking spring member 132 permits the adjusting member 78 to be manually moved. Manual movement is most easily accomplished by the index finger of the left hand moved rearwardly from the nosepiece 56 alongside the adjusting member 78 in parallel relation to the longitudinal extent of the magazine 34. It can be seen that by digital engagement of the striated periphery 80 of the adjusting member 78, the operator can effect a turning movement in either direction to adjust the position of the work contacting block 72 into the desired position which will accommodate the desired extent of countersink.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications encompassed within the spirit and scope of the following claims.

What is claimed is:

1. In a portable power activated fastener driving device including a portable housing having means defining a drive track including a fixed nosepiece, power operated fastener driving means including a fastener driving element carried by said housing for movement within said drive track through successive cycles of operation each of which includes a fastener driving stroke wherein an end of said fastener driving element stops at a predetermined position extending outwardly of said fixed nosepiece and a return stroke, fastener magazine means carried by said housing for receiving a supply of fasteners and feeding successive fasteners into the drive track in a position to be driven into a workpiece during successive fastener driving strokes of said fastener driving means, power control means including an actuating member carried by said housing for movement from a normal inoperative position into an operative position for initiating the movement of said fastener driving means through a fastener driving stroke, a work contact assembly carried by said housing for movement from a normal inoperative position into an operative position in response to the movement of said device into cooperating engagement with a workpiece, a trigger member carried by said housing for manual movement from a normal inoperative position into an operative position, and enabling means enabling movement of said trigger member and said work contact assembly into their operative positions to effect movement of said actuating member into its operative position, the improvement which comprises said work engaging assembly including a first structure having a portion extending from said nosepiece in the direction of extent of said drive track therefrom and a second structure having a portion operatively associated with said enabling means, interengaging threaded means interconnecting said first and second structures for relative movement between a first position of adjustment wherein said first structure portion when said work contact assembly is in its operative position extends from said nosepiece a maximum extent and a fastener driven into a workpiece by said fastener driving element has a minimum countersunk relation and a second position of adjustment wherein said first structure portion when said work contact assembly is in its operative position extends from said fixed nosepiece a minimum extent and a fastener driven into a workpiece by said fastener driving element has a maximum countersunk relation, said threaded means including manually engageable surface means for enabling the same to be manually turned to move said structures in a multiplicity of different positions between said first and second positions of adjustment, and manually operable means for releasably locking said threaded means in any position into which it is manually turned.

2. The improvement as defined in claim 1 wherein said threaded means includes an exteriorly threaded portion on one of said structures, an interiorly threaded member threadedly engaged on said exteriorly threaded portion and means mounting said interiorly threaded member on the other of said structures for rotational movement with respect thereto and against substantial axial movement with respect thereto.

3. The improvement as defined in claim 2 wherein said manually engageable surface means includes a striated exterior cylindrical surface on said interiorly threaded member.

4. The improvement as defined in claim 3 wherein said releasable locking means includes a locking element mounted for movement between a locking position in engagement with the striated exterior cylindrical surface of said interiorly threaded member and a releasing position out of engagement with the striated exterior cylindrical surface of said interiorly threaded member.

5. The improvement as defined in claim 4 wherein said releasable locking means also includes manually operable door means movable between a closed position preventing manual access to the striated exterior cylindrical surface of said interiorly threaded member and an open position enabling manual access to the striated exterior cylindrical surface of said interiorly threaded member and means for moving said locking member between said locking and releasing positions when said door means is manually moved between said closed and open positions respectively.

6. The improvement as defined in claim 5 wherein said access door means includes a door mounted for swinging movement between said closed and open positions and spring means for yieldingly resiliently retaining said door in said closed and open positions.

7. The improvement as defined in claim 6 wherein said second structure has spring means operatively associated therewith for resiliently urging said second structure and the first structure secured thereto into said inoperative position.

8. The improvement as defined in claim 7 wherein said releasable locking means also includes manually operable door means movable between a closed position preventing manual access to the striated exterior cylindrical surface of said interiorly threaded member and an open position enabling manual access to the striated exterior cylindrical surface of said interiorly threaded member and means for moving said locking member between said locking and releasing positions when said door means is manually moved between said closed and open positions respectively.

9. The improvement as defined in claim 8 wherein said access door means includes a door mounted for swinging movement between said closed and open positions and spring means for yieldingly resiliently retaining said door in said closed and open positions.

10. The improvement as defined in claim 2 wherein said releasable locking means includes a locking element mounted for movement between a locking position in engagement with the striated exterior cylindrical surface of said interiorly threaded member and a releasing position out of engagement with the striated exterior cylindrical surface of said interiorly threaded member.

11. The improvement as defined in claim 1 wherein said second structure has spring means operatively associated therewith for resiliently urging said second structure and the first structure secured thereto in said inoperative position.

12. A portable power actuated fastener driving device including a portable housing having means defining a drive track including a fixed nosepiece, power operated fastener driving means including a fastener driving element carried by said housing for movement within said drive track through successive cycles of operation each of which includes a fastener driving stroke wherein an end of said fastener driving element stops at a predetermined position extending outwardly of said fixed nosepiece and a return stroke, fastener magazine means carried by said housing for receiving a supply of fasteners and feeding successive fasteners into the drive track in a position to be driven into a workpiece during successive fastener driving strokes of said fastener driving means, power control means including an actuating member carried by said housing for movement from a normal inoperative position into an operative position for initiating the movement of said fastener driving means through a fastener driving stroke, a work contact assembly carried by said housing for movement from a normal inoperative position into an operative position in response to the movement of said device into cooperating engagement with a workpiece, a trigger member carried by said housing for manual movement from a normal inoperative position into an operative position, and enabling means enabling movement of said trigger member and said work contact assembly into their operative positions to effect movement of said actuating member into its operative position, said work contact assembly including a manual adjusting mechanism for adjusting the extent to which fasteners driven by said fastener driving element are countersunk into the workpiece, said manual adjusting mechanism including a manually operable member movable by manual engagement to effect an adjustment of said adjusting mechanism, releasably locking means movable between a locking position for locking said manually operable member against manual movement and a releasing position enabling said manually operable member to be manually moved, guard means enclosing at least a portion of said adjusting mechanism including said manually operable member, said guard means including manually operable access door means movable between a closed position wherein said manually operable member is manually inaccessible within said guard means and an open position wherein said manually operable member is manually accessible, and means for moving said releasable locking means between said locking and releasing positions when said access door means is manually moved between said closed and open positions respectively.

13. A fastener driving device as defined in claim 12 wherein said housing means includes spring means operatively associated with said access door means for yieldably resiliently retaining said access door means in said closed and open positions.

* * * * *